US006409166B1

(12) United States Patent
Kashimura

(10) Patent No.: US 6,409,166 B1
(45) Date of Patent: Jun. 25, 2002

(54) SHEET RECEIVING APPARATUS

(75) Inventor: Makoto Kashimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/567,984

(22) Filed: May 10, 2000

(30) Foreign Application Priority Data

May 12, 1999 (JP) ..... 11-131191

(51) Int. Cl.[7] ..... B65H 31/04; B65H 39/10
(52) U.S. Cl. ..... 271/213; 271/292
(58) Field of Search ..... 271/213, 292

(56) References Cited

U.S. PATENT DOCUMENTS 5,061,098 A * 10/1991 Engelhardt et al. ..... 271/213 X
5,105,210 A 4/1992 Hirano et al.
5,175,583 A * 12/1992 Noh et al. ..... 271/213 X
5,362,163 A * 11/1994 Takano ..... 271/213 X
5,384,586 A 1/1995 Hirano et al.
5,725,207 A * 3/1998 Deguchi ..... 271/213 X
5,876,033 A * 3/1999 Lonati ..... 271/213 X
6,027,114 A * 2/2000 Watanabe et al. ..... 271/213 X
6,076,923 A 6/2000 Kashimura et al.

* cited by examiner

*Primary Examiner*—Christopher P. Ellis
*Assistant Examiner*—Gene O. Crawford
(74) *Attorney, Agent, or Firm*—Fitzpatrick, Cella, Harper & Scinto

(57) ABSTRACT

A sheet receiving apparatus includes a tray swingably supported by an apparatus main body so that it is selectively put to a state of use, in which sheets can be loaded thereon, and to a state of accommodation and a regulation unit abutted against the tray for regulating the swing motion thereof to keep the state of accommodation, wherein the center of swing of the tray is arranged movably and the tray can be shifted to the state of use by releasing the swing thereof regulated by the regulation unit by moving the center of swing thereof. With this arrangement, the sheet receiving apparatus can be highly reliably arranged without an increase in a cost and has no possibility of the deformation and breakage of the parts thereof.

35 Claims, 7 Drawing Sheets

SHEET RECEIVING APPARATUS

BACKGROUND OF THE INVENTION

1. Filed of the invention

The present invention relates to a sheet receiving apparatus which is mounted on an image forming apparatus such as a copying machine, a printer, a recording device and the like and on a sheet processing apparatus for carrying out binding and the like, and so on for loading sheets such as recording sheets and the like thereon. In particular, the present invention relates to the arrangement of a sheet receiving apparatus which can be selectively put in two states, that is, a state of use and a state of accommodation and has a center of rotation through which the two states can be selected by the rotational motion of the tray.

2. Description of the Related Art

In general, recording apparatuses are provided with a sheet tray as a sheet receiving apparatus such as a sheet feed tray for holding recording mediums on which images are to be recorded, a discharged sheet tray for holding recording mediums on which the images have been recorded, and the like.

In these recording apparatuses, the sheet tray is arranged such that it can be accommodated when it is not used to save a space.

There is a method of accommodating the sheet tray by sliding it into the main body of the recording apparatus as the accommodating methods thereof. However, a problem arises in this method in that the size of the recording apparatus main body is increased to secure a space for accommodating it.

To solve the above problem, there is also proposed a method of selectively putting the sheet tray in the state of use and the state of accommodation by rotating it.

In the above arrangement, it is necessary to hold the sheet tray by additionally providing an elastic member such as a metal spring or the like or to form an elastically deformable portion at a part of the sheet tray or at a part of a recording apparatus main body in order to keep the state of the sheet tray when it is accommodated.

In the above arrangement, however, a cost is increased by the addition of the elastic member such as the metal spring or the like.

While it has been proposed to form the elastically deformable portion at a part of the sheet tray or at a part of the recording apparatus main body without the addition of the elastic member such as the metal spring or the like to keep the state of the sheet tray when it is accommodated, there is caused a problem in that the accommodated state of the sheet tray cannot be kept due the deformation or breakage of the elastic portion. Thus, there has been desired a sheet tray having a reliable structure by which the state of accommodation of the sheet tray can be reliably kept without an increase in a cost.

SUMMARY OF THE INVENTION

An object of the present invention for solving the above problem is to provide a sheet tray having high reliability without an increases in a cost which can securely keep the state of accommodation of the sheet tray through a simple arrangement and is not broken even if it is handled somewhat violently.

To achieve the above object, a sheet receiving apparatus of the present invention includes a tray swingably supported by an apparatus main body so that it is selectively put to a state of use, in which sheets can be loaded thereon, and to a state of accommodation; and a regulation unit abutted against the tray for regulating the swing motion thereof to keep the state of accommodation, wherein the center of swing of the tray is arranged movably and the tray can be shifted to the state of use by releasing the swing thereof regulated by the regulation unit by moving the center of swing thereof.

According to a first aspect of the present invention, a sheet receiving apparatus includes a tray and a regulation unit. The tray is rotatably supported about a center of rotation by an apparatus main body to be selectively positioned in a use position, in which sheets can be loaded thereon, and in an accommodation position. The regulation unit is abuttable against the tray for regulating a rotational motion thereof when the tray is in the accommodation position to maintain the tray in the accommodation position. The center of rotation of the tray is arranged movably and the tray is shiftable from the accommodation position to the use position by permitting the rotational motion thereof, regulated by the regulation unit, by moving the center of rotation thereof.

According to another aspect of the present invention, a sheet receiving apparatus includes a tray, supporting means and regulation means. The tray loads a sheet. The supporting means rotatably supports the tray in a rotational motion between a use position in which the sheet is loadable thereon and an accommodation position. The regulation means abuts against the tray when in the accommodation position so as to regulate the rotational motion of the tray to thereby maintain the tray in the accommodation position. The tray is releasable from the regulation means by application of a rotational force to slide the tray over the regulation means.

According to yet another aspect of the present invention a sheet receiving apparatus includes a tray and a regulation means. The tray is rotatably supported about a center of rotation by an apparatus main body to be selectively positioned in a use position, in which sheets can be loaded thereon, and in an accommodation position. The regulation means abuts against the tray and regulates a rotational motion thereof when the tray is in the accommodation position to maintain the tray in the accommodation position. The center of rotation of the tray is arranged movably and the tray is shiftable from the accommodation position to the use position by permitting the rotational motion thereof, regulated by the regulation means, by moving the center of rotation thereof.

According to still another aspect of the present invention a sheet receiving apparatus includes a tray, a support and a regulation unit. The tray loads a sheet. The support rotatably supports the tray in a rotational motion between a use position in which the sheet is loadable thereon and an accommodation position. The regulation unit is abuttable against the tray when in the accommodation position so as to regulate the rotational motion of the tray to thereby maintain the tray in the accommodation position. The tray is releasable from the regulation unit by application of a rotational force to slide the tray over the regulation unit.

DETAILED DESCRIPTION OF THE PREFERRED EMBODIMENT

An embodiment in which the present invention is applied to an inkjet recording apparatus as an example of a recording apparatus which is a kind of an image forming apparatus will be specifically described with reference to the accompanying drawings.

Figure 3:
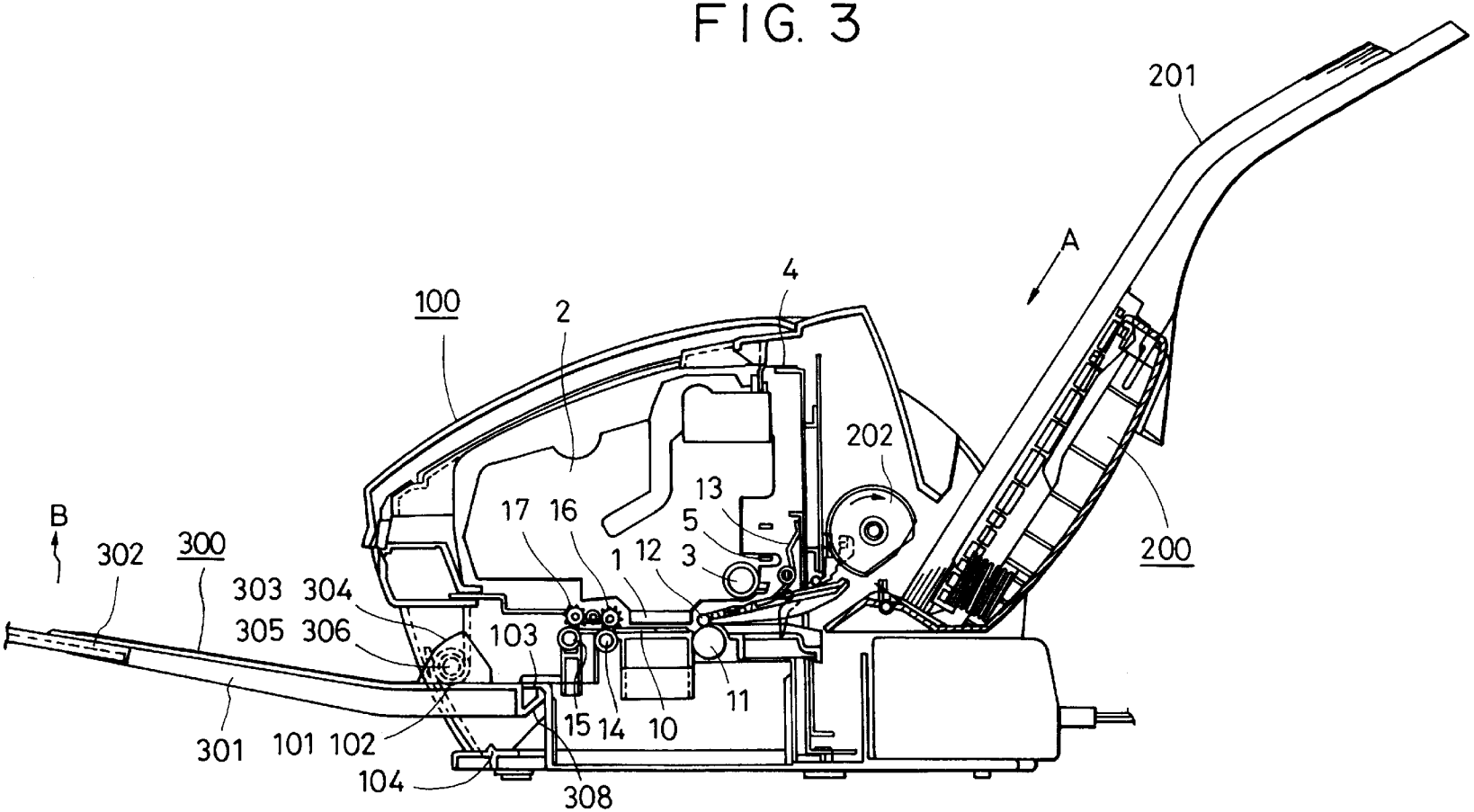
FIG. 3 is a schematic sectional view showing an arrangement of the recording apparatus according to the present invention (a state in which the discharged sheet tray is used).
Figure 4:
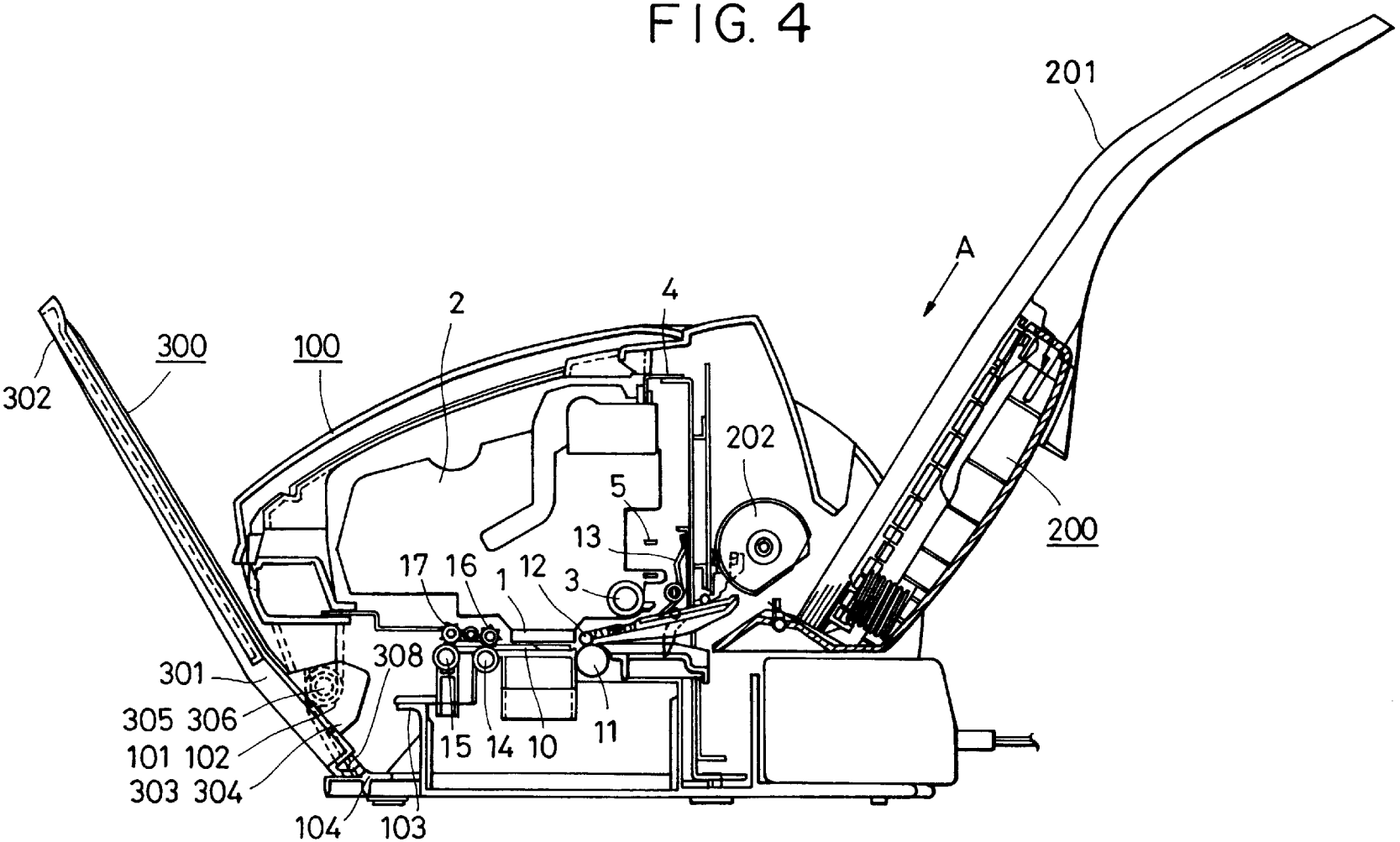
FIG. 4 is a schematic sectional view showing an arrangement of the recording apparatus according to the present invention (a state in which the discharged sheet tray is accommodated).

As shown in FIG. 3, an inkjet recording apparatus 100 of the embodiment includes a recording head 1 as an image forming means mounted on a carriage 2 to form an image on a recording medium by ejecting ink thereto. The carriage 2 is supported by a carriage shaft 3 and a guide rail 4 and reciprocated in a direction perpendicular to the feed direction (direction vertical to a sheet surface) of a recording medium 201 as a sheet by a carriage drive motor (not shown) through a timing belt 5. An image is formed on the surface of the recording medium by the ink ejected from the recording head 1 during the movement of the recording head 1 while the reciprocating movement of the recording head 1 caused by the movement of the a carriage 2 and the feed operation of the recording medium at each predetermined pitch are alternately carried out.

A feed roller 11 and a pinch roller 12, which constitute a feed means for feeding recording mediums, are disposed below the a carriage 2. In the embodiment, the recording mediums are fed one by one to a feed means from an auto sheet feeder 200 disposed rearward of the carriage 2.

The recording mediums are fed from the auto sheet feeder 200 to the feed means by a sheet feed roller 202. On the reception of a sheet feed command issued from a computer or the like connected to the apparatus 100, the sheet feed roller 202 is rotated clockwise, separates each of a multiplicity of the recording mediums 201 from the bundle thereof loaded on the auto sheet feeder 200 and feeds them in the direction of an arrow A shown in FIG. 3. Each recording medium 201 is fed from the sheet feed roller 202 until the extreme end thereof reaches the nip between the feed roller 11 and the pinch roller 12 and stopped thereat in a state that the recording medium 201 is curved between the nip and the sheet feed roller 202.

Next, the feed roller 11 is rotated counterclockwise by a sheet feed motor (not shown), and the recording medium 201 having been fed to the feed means is fed while being clamped between the feed roller 11 and the pinch roller 12 which is urged into contact with the feed roller 11 by an urging spring 13.

The recording medium 201 is fed in a left direction in FIG. 3 along the platen 10 as a recording section and stopped when the portion of the recording medium 201, to which a first line of images is printed, reaches the recording position of the platen 10.

The recording head 1 reciprocates in a direction vertical to the sheet surface while ejecting ink in accordance with image information in the state that the recording medium 201 is stopped so as to record an image having a predetermined width (recording width) in the feed direction. Thereafter, the recording medium 201 is fed by the recording width by the feed roller 11 and stopped again and images are recorded in the recording width by the recording head 1. The images are recorded onto the recording medium 201 by alternately repeating the feed operation and the recording operation.

Sheet discharge rollers 14 and 15 and spurs 16 and 17 for pressing the recording medium against the sheet discharge rollers 14 and 15 are disposed downstream of the platen 10 in the feed direction of the recording medium. The sheet discharge rollers 14 and 15 are driven in synchronism with the feed roller 11 while the recording operation is carried out, whereby the recording medium is fed by the predetermined recording width. After the completion of the recording operation, the recording medium, onto which the images have been formed by the recording head 1, is discharged to the outside of the recording apparatus by the sheet discharge rollers 14 and 15. Each of the spurs 16 and 17 is a rotor having a multiplicity of sharp projections formed around the outer periphery thereof so that the extreme end of each projection comes into contact with the recording medium 201 in a minute area.

Figure 1:
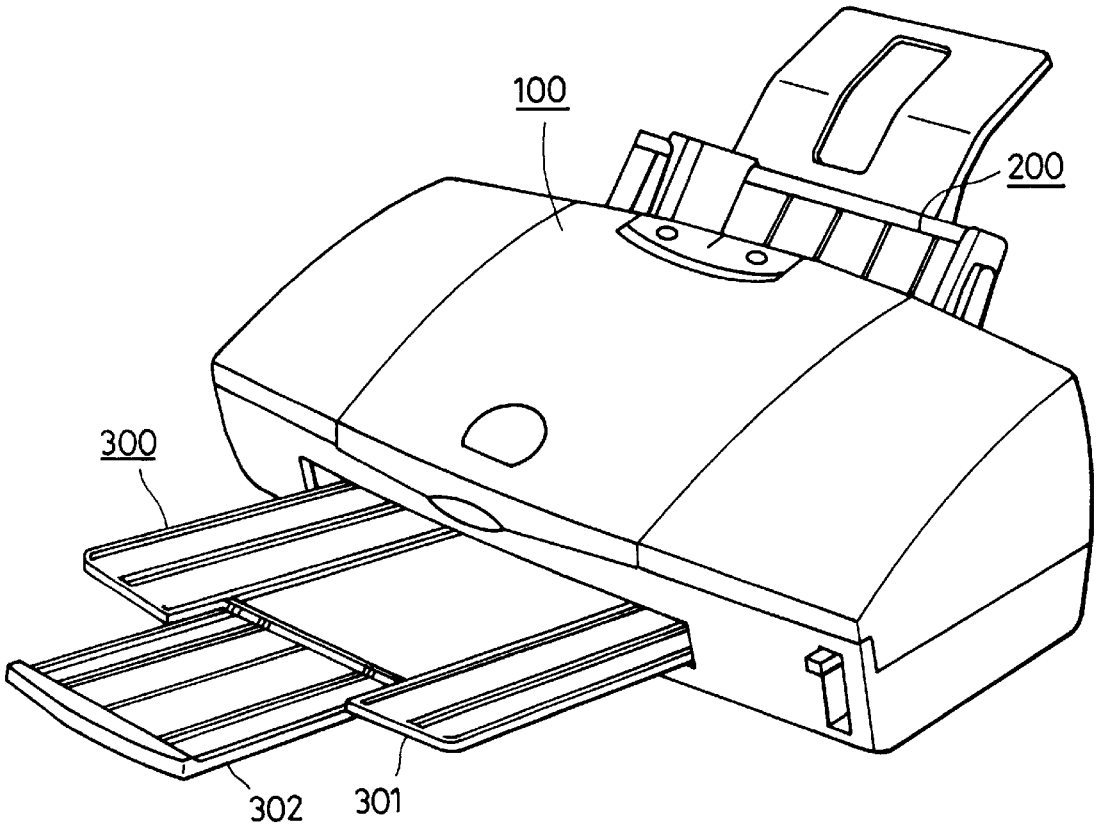
FIG. 1 is a schematic perspective view showing an arrangement of a recording apparatus according to the present invention.

The recording medium 201 having been discharged from the recording apparatus by the sheet discharge rollers 14 and 15 and the spurs 16 and 17 is loaded on a discharged sheet tray unit 300 as a tray. Note that the discharged sheet tray unit 300 is composed of a discharged sheet tray 301 and a sub discharged sheet tray 302 so that a recording sheet which is long in the feed direction can be sufficiently loaded as shown in FIG. 1, and the sub discharged sheet tray 302 can be freely expanded and contracted in the feed direction of the recording medium with respect to the discharged sheet tray 301.

Next, the arrangement of the discharged sheet tray unit 300 according to the present invention will be described with reference to FIGS. 3 to 7. Side walls 303 and 304 are disposed to the ends of the discharged sheet tray 301 in the width direction thereof perpendicular to the feed direction of the recording medium, and swing shafts 305 and 306 are disposed to the side walls 303 and 304, respectively.

U-shaped groove-like discharged sheet tray mounting sections (shaft receiving sections) 101 and 102, which have openings 106 at the upper portions thereof, are disposed to the inner walls of the main body of the inkjet recording apparatus 100 in the width direction thereof perpendicular to the feed direction of the recording medium downwardly of the sheet discharge roller 15 and the spur 17.

The swing shafts 305 and 306 of the discharged sheet tray unit 300 are fallen into the U-shaped grooves of the discharged sheet tray mounting sections 101 and 102 and engaged therewith. With this arrangement, the discharged sheet tray unit 300 is mounted on the inkjet recording apparatus 100 so as to swing with respect to the inkjet recording apparatus 100 about the centers of the swing shafts 305 and 306.

When the discharged sheet tray unit 300 is in a state of use (FIGS. 1, 3 and 5), the position thereof at which it is used is determined in such a manner that the discharged sheet tray 301 is supported by the discharged sheet tray mounting sections 101 and 102 as well as the counterclockwise swing thereof is regulated by the upper surface 307 of the upstream end 308 of the discharged sheet tray 301 in the feed direction abutted against a stopper 300 disposed to the main body of the inkjet recording apparatus 100. Further, the weight of the discharged sheet tray unit 300 can be supported as well as the weight of the recording mediums loaded on the discharged sheet tray unit 300 can be supported.

Next, operation performed when the discharged sheet tray unit 300 is made to a state of accommodation will be described. When the discharged sheet tray unit 300 is swung in the direction of an arrow B in FIGS. 3 and 5, the upstream end 308 of the discharged sheet tray 301 begins to be abutted against a convex section 104 as a regulating means disposed to the inkjet recording apparatus 100. At the time, the discharged sheet tray unit 300 is pushed upward because the upstream end 308 is formed in a cam shape. As a result, the swing shafts 305 and 306 are guided by the U-shaped grooves of the discharged sheet tray mounting sections 101 and 102 so that the discharged sheet tray unit 300 can continue its swing motion while moving the center of swing thereof upward. When the discharged sheet tray unit 300 is further swung, the upstream end 308 gets over the convex section 104 and the state of the discharged sheet tray unit 300 shown in FIG. 6 is achieved.

In this state (FIG. 6), since the upstream end 308 gets over the convex section 104, the discharged sheet tray unit 300 is moved downward again and the swing shafts 305 and 306 are also moved downward by being guided by the U-shaped grooves of the discharged sheet tray mounting sections 101 and 102. At the time, since the upper cam surface 308*a* of the upstream end 308 is abutted against the downstream end surface 104*a* of the convex section 104 at an angle which is sufficient to support the weight of the discharged sheet tray unit 300, the swing of the discharged sheet tray unit 300 is regulated by the convex section 104 so that the state of accommodation thereof can be kept.

A convex section 104 having a length covering the entire width of the discharged sheet tray unit 300 may be formed over the entire sheet discharge section of the recording apparatus main body. Otherwise, or one or a plurality of convex sections 104 may be formed at suitable positions of the recording apparatus main body in the width direction thereof.

Figure 5:
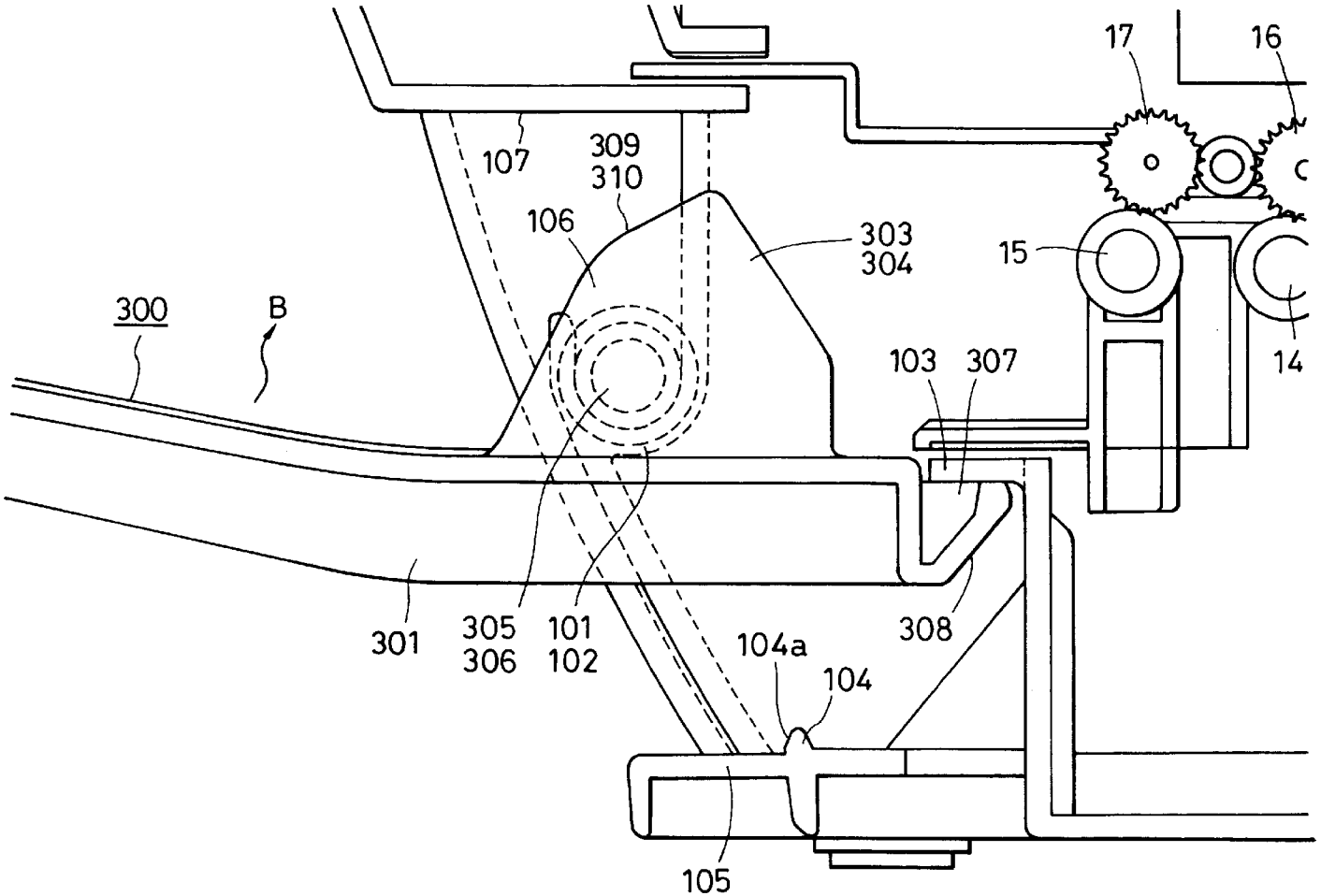
FIG. 5 is an enlarged view showing the state of use of the discharged sheet tray according to the present invention is used.
Figure 6:
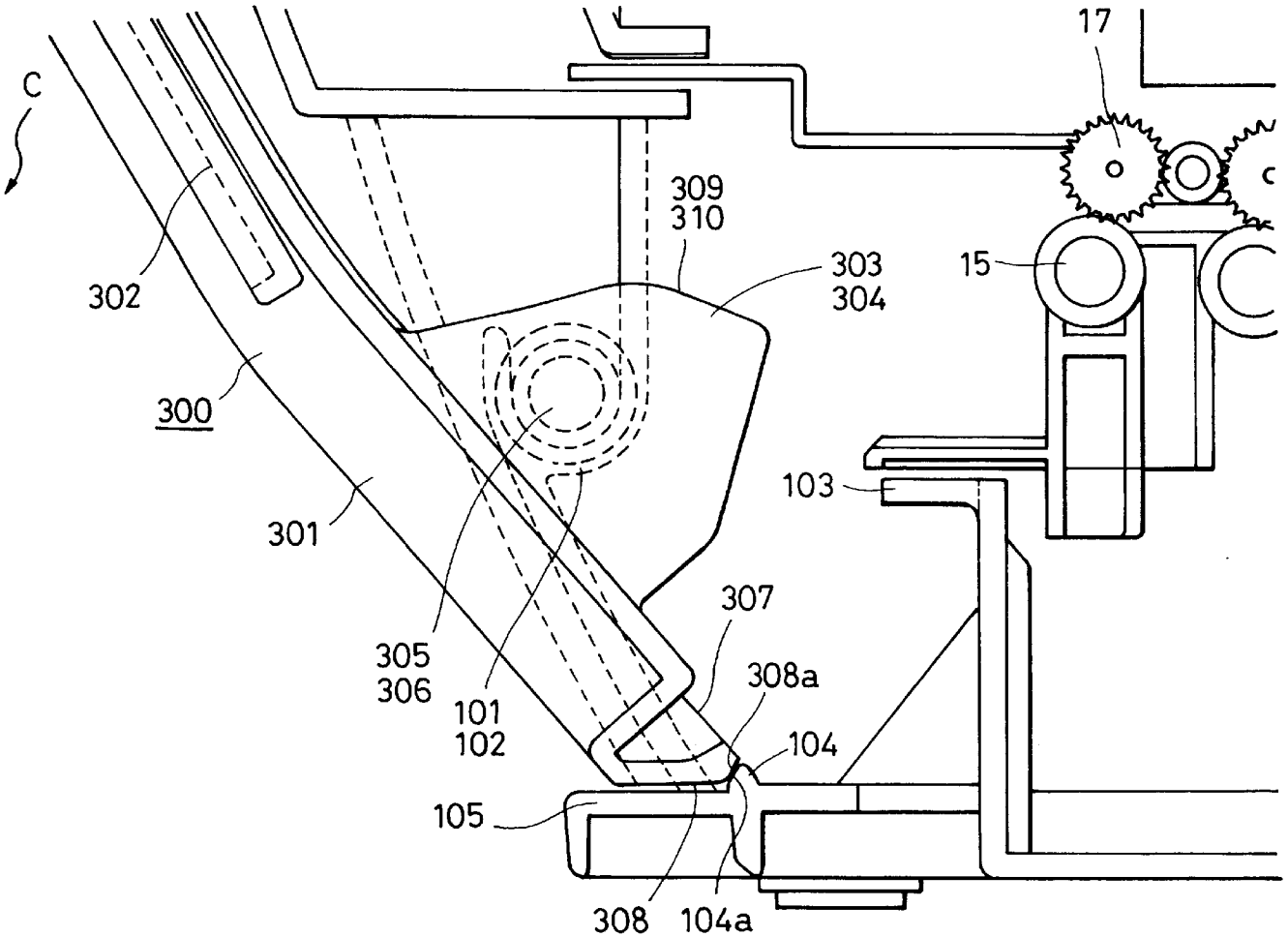
FIG. 6 is an enlarged view showing the state of accommodation of the discharged sheet tray according to the present invention.
Figure 7:
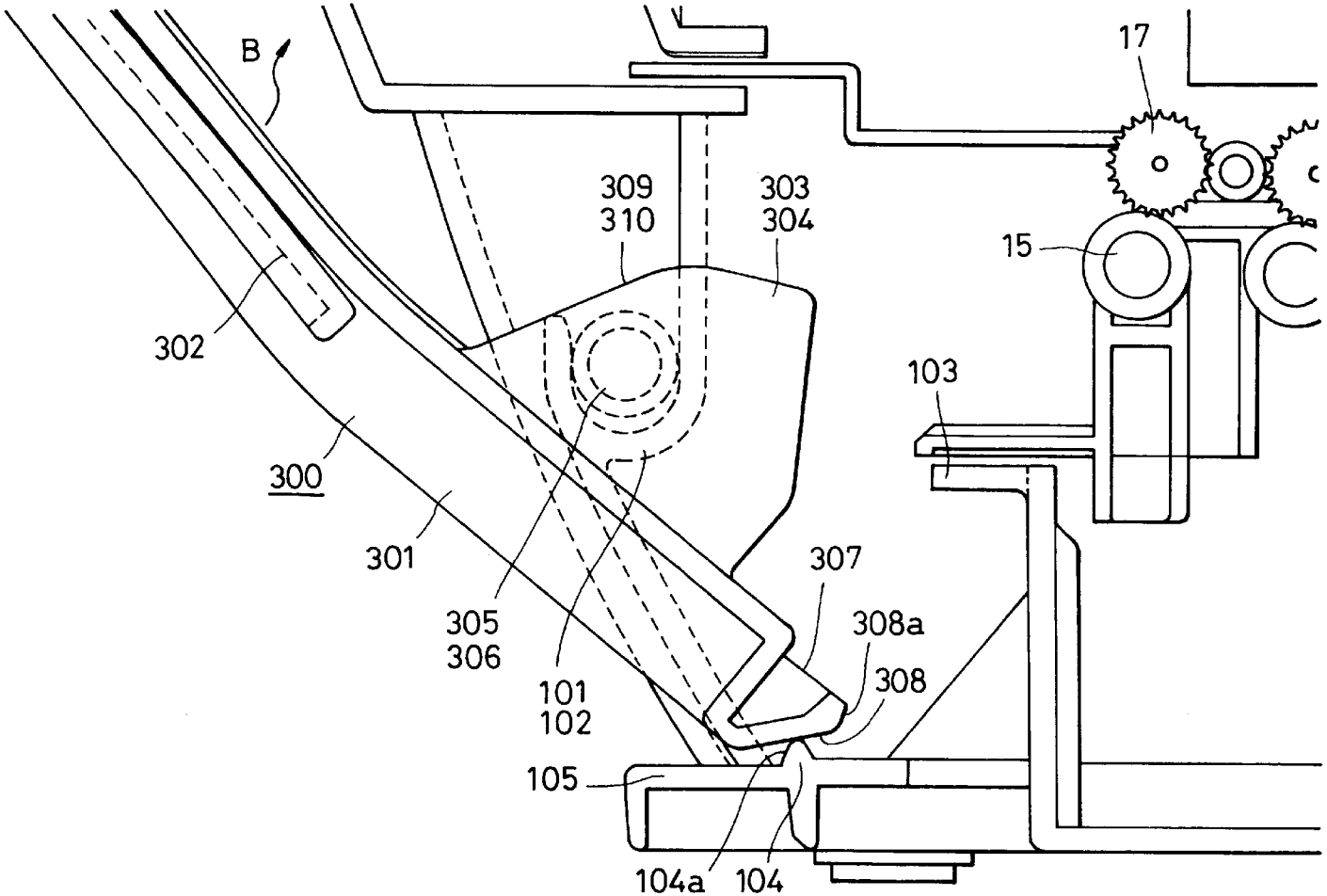
FIG. 7 is a view explaining the state of operation of the discharged sheet tray according to the present invention.

When the discharged sheet tray unit 300 is shifted from the state of accommodation to the state of use, it is pushed down in the direction of an arrow C in FIG. 6. With this operation, the upstream end 308 gets over the convex section 104 and the discharged sheet tray unit 300 can be swung because the swing thereof regulated by the convex section 104 is released, whereby the state of use of the discharged sheet tray unit 300 can be achieved (FIGS. 3 and 5).

When force is imposed on the discharged sheet tray unit 300 in the direction of the arrow C in FIG. 6 to shift it from the state of accommodation to the state of use, the discharged sheet tray unit 300 is lowered at the center in the width direction thereof and deformed concavely in a lower direction as a whole. At the time, the upstream end 308 is also lowered at the center thereof and more engaged with the convex section 104. Thus, the upstream end 308 may not get over the convex section 104.

Figure 2:
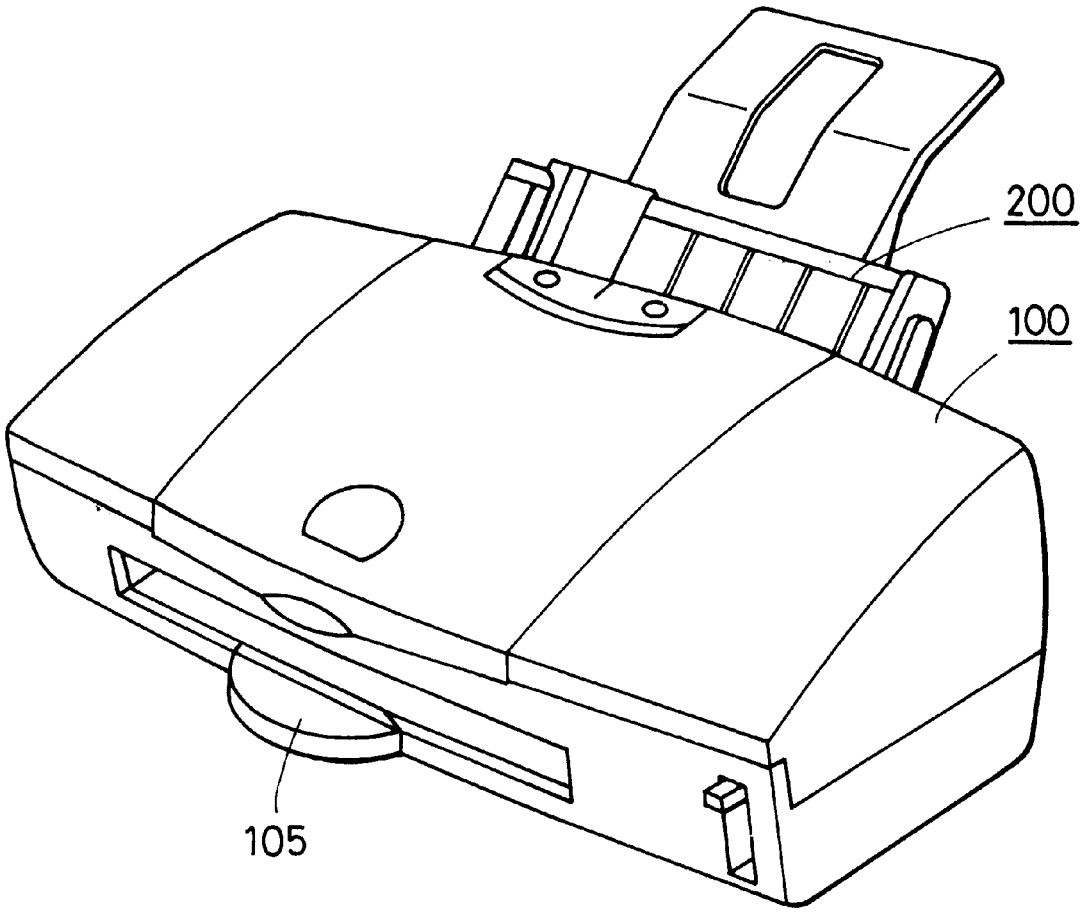
FIG. 2 is a schematic perspective view showing a state in which a discharged sheet tray is removed.

To prevent the occurrence of this problem, a support section 105 is formed to the inkjet recording apparatus 100 as shown in FIG. 2. Accordingly, even if the discharged sheet tray unit 300 is deformed, it is abutted against the a support section 105 to prevent the further deformation thereof. With this arrangement, the upstream end 308 can get over the convex section 104.

The discharged sheet tray unit 300 is arranged detachably to reduce the size of the recording apparatus main body when it is transported or when it is packaged. Accordingly, guide surfaces 309 and 310 are formed on the side walls 303 and 304 so that the discharged sheet tray unit 300 can be reliably mounted on the inkjet recording apparatus 100, that is, the discharged sheet tray unit 300 can be reliably mounted by being guided along the inside upper surface 107 of the inkjet recording apparatus 100.

Note that the above embodiment is arranged such that the swing shafts are provided with the discharged sheet tray unit and the U-shaped mounting sections are formed to the recording apparatus main body. It is needless to say, however, that a similar effect can be obtained by an arrangement opposite to the above arrangement, that is, by an arrangement in which the swing shafts are provided with the recording apparatus main body and slot-shaped or U-shaped receiving sections, into which the swing shafts are loosely fitted, are formed on the discharged sheet tray unit.

It is sufficient for the swing shafts to move in the mounting sections (shaft receiving sections) in such a degree as to permit the end of the discharged sheet to get over the projection. Thus, the mounting sections may be formed in a circular shape or an oval shape without opening in addition to the U-shape so that the swing shafts can be loosely fitted thereinto.

In the above embodiment, the upstream end of the tray is formed in the cam shape and gets over the convex section. However, the cam surface may be formed on the convex section or both the upstream end and the projection may be formed in the cam shape.

Further, while the above embodiment is described as to the arrangement of the discharged sheet tray unit of the inkjet recording apparatus, the present invention is not limited thereto and can be embodied in the arrangement of a sheet tray of a recording apparatus employing other recording system or in the arrangement of a sheet tray of an image forming apparatus. That is, it is needless to say that the present invention can be embodied in the arrangement of, for example, a discharged sheet tray of a copying machine and a laser beam printer (LBP) and in the arrangement of a sheet feed tray on which recording sheets to be fed into an apparatus main body are loaded. Furthermore, the present invention can be also embodied in a sheet processing apparatus for binding the bundle of sheets using a stapler or the like or folding or punching sheets.

As described above, according to the present invention, there can be provided a sheet receiving apparatus having high reliability the cost of which is not increased because elastic parts such as metal springs or the like need not be added and elastically deformable sections also need not be formed and which has no possibility that the components thereof are deformed or broken.

While the present invention has been described with respect to what is currently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A sheet receiving apparatus comprising:

a tray rotatably supported about a center of rotation by an apparatus main body to be selectively positioned in a use position, in which sheets can be loaded thereon, and in an accommodation position; and a regulation unit abuttable against said tray for regulating a rotational motion thereof when said tray is in the accommodation position to maintain said tray in the accommodation position, wherein the center of rotation of said tray is arranged movably and said tray is shifted from the accommodation position to the use position by permitting the rotational motion thereof, regulated by said regulation unit, by moving the center of rotation thereof in a direction transverse to the axis of the center of rotation.

2. A sheet receiving apparatus according to claim 1, wherein a sheet discharged from the apparatus main body is loaded on said tray.

3. A sheet receiving apparatus according to claim 1, wherein said tray is rotatably supported by a processing apparatus main body for processing a sheet.

4. A sheet receiving apparatus according to claim 1, wherein a sheet to be fed into the apparatus main body is loaded on said tray.

5. A sheet receiving apparatus according to claim 1, wherein said regulation unit comprises a convex section abuttable against said tray in the accommodation position, the regulation of the rotational motion of said tray being released by allowing said tray to slide over said convex section by moving the center of rotation of said tray.

6. A sheet receiving apparatus according to claim 5, wherein said convex section is abutted against an end of said tray located adjacent the center of rotation of said tray.

7. A sheet receiving apparatus according to claim 1, wherein said tray is rotatably supported by an image forming apparatus main body for forming an image on a sheet.

8. A sheet receiving apparatus according to claim 7, wherein the image forming apparatus main body includes ink-jet recording means for forming an image by ejecting ink onto a sheet.

9. A sheet receiving apparatus according to claim 1, further comprising one of a shaft and a shaft receiving section disposed on said tray, wherein the other of said shaft and said shaft receiving section is disposed on the apparatus main body, said tray being rotationally supported by loosely fitting said shaft into said shaft receiving section.

10. A sheet receiving apparatus according to claim 9, wherein said shaft receiving section is formed on the apparatus main body as a U-shaped groove having an open upper portion.

11. A sheet receiving apparatus according to claim 10, wherein said tray is removable from the apparatus main body by passing said shaft through the open upper portion of the U-shaped groove.

12. A sheet receiving apparatus, comprising:

a tray for loading a sheet;

supporting means for rotatably supporting said tray in a rotational motion about a center of rotation between a use position in which the sheet is loadable thereon and an accommodation position; and regulation means for abutting against said tray when in the accommodation position so as to regulate the rotational motion of said tray to thereby maintain said tray in the accommodation position, wherein said tray is released from said regulation means by application of a rotational force to move the center of rotation of said supporting means in a direction transverse to the axis of the center of rotation and slide said tray over said regulation means.

13. A sheet receiving apparatus according to claim 12, wherein the rotational force applied to release said tray from said regulation means is greater than a rotational force due to the weight of said tray.

14. A sheet receiving apparatus according to claim 12, wherein an end of said tray opposite to a portion thereof where the sheet is loaded and adjacent said supporting means abuts against said regulation means.

15. A sheet receiving apparatus according to claim 14, wherein at least one of said regulation means and the end of said tray includes a cam surface.

16. A sheet receiving apparatus according to claim 12, wherein said tray is rotatably supported in an image forming apparatus for forming an image on a sheet.

17. A sheet receiving apparatus according to claim 16, wherein the image forming apparatus comprises an ink-jet recording means for forming an image by ejecting ink.

18. A sheet receiving apparatus, comprising:

a tray rotatably supported about a center of rotation by an apparatus main body to be selectively positioned in a use position, in which sheets can be loaded thereon, and in an accommodation position; and regulation means for abutting against said tray and regulating a rotational motion thereof when said tray is in the accommodation position to maintain said tray in the accommodation position, wherein the center of rotation of said tray is arranged movably and said tray is shifted from the accommodation position to the use position by permitting the rotational motion thereof, regulated by said regulation means, by moving the center of rotation thereof in a direction transverse to the axis of the center of rotation.

19. A sheet receiving apparatus according to claim 18, wherein a sheet discharged from the apparatus main body is loaded on said tray.

20. A sheet receiving apparatus according to claim 18, wherein a sheet to be fed into the apparatus main body is loaded on said tray.

21. A sheet receiving apparatus according to claim 18, wherein said tray is rotatably supported by a processing apparatus main body for processing a sheet.

22. A sheet receiving apparatus according to claim 18, wherein said tray is rotatably supported by an image forming apparatus main body for forming an image on a sheet.

23. A sheet receiving apparatus according to claim 22, wherein the image forming apparatus main body includes ink-jet recording means for forming an image by ejecting ink onto a sheet.

24. A sheet receiving apparatus according to claim 18, further comprising one of a shaft and a shaft receiving section disposed on said tray, wherein the other of said shaft and said receiving section is disposed on the apparatus main body, said tray being rotatably supported by loosely fitting said shaft into said shaft receiving section.

25. A sheet receiving apparatus according to claim 24, wherein said shaft receiving section is formed on the apparatus main body as a U-shaped groove having an open upper portion.

26. A sheet receiving apparatus according to claim 25, wherein said tray is removable from the apparatus main body by passing said shaft through the open upper portion of the U-shaped groove.

27. A sheet receiving apparatus, comprising:

a tray for loading a sheet;

a support for rotatably supporting said tray in a rotational motion about a center of rotation between a use position in which the sheet is loadable thereon and an accommodation position; and a regulation unit abuttable against said tray when in the accommodation position so as to regulate the rotational motion of said tray to thereby maintain said tray in the accommodation position, wherein said tray is released from said regulation unit by application of a rotational force to move the center of rotation of said support in a direction transverse to the axis of the center of rotation and slide said tray over said regulation unit.

28. A sheet receiving apparatus according to claim 27, wherein said support comprises one of a shaft and a shaft receiving section, one of said shaft and said shaft receiving section being disposed on said tray and the other of said shaft and said shaft receiving section being disposed on an apparatus main body, and said support rotatably supporting said tray by loosely fitting said shaft into said shaft receiving section.

29. A sheet receiving apparatus according to claim 27, wherein the rotational force applied to release said tray from said regulation unit is greater than a rotational force due to the weight of said tray.

30. A sheet receiving apparatus according to claim 27, wherein an end of said tray opposite to a portion thereof where the sheet is loaded and adjacent said support abuts against said regulation unit.

31. A sheet receiving apparatus according to claim 30, wherein at least one of said regulation unit and the end of said tray includes a cam surface.

32. A sheet receiving apparatus according to claim 27, wherein said tray is rotatably supported in an image forming apparatus for forming an image on a sheet.

33. A sheet receiving apparatus according to claim 32, wherein the image forming apparatus comprises an ink-jet recording means for forming an image by ejecting ink.

34. A recording apparatus for recording on a recording medium with a recording head, comprising:

head mounting means for mounting the recording head;

a tray for loading the recording medium recorded by the recording head;

supporting means for rotatably supporting said tray in a rotational motion about a center of rotation between a use position in which the recording medium is loadable thereon and an accommodation position; and regulation means for abutting against said tray when in the accommodation position so as to regulate the rotational motion of said tray to thereby maintain said tray in the accommodation position, wherein said tray is released from said regulation means by application of a rotational force to move the center of rotation of said supporting means in a direction transverse to the axis of the center of rotation and slide said tray over said regulation means.

35. A recording apparatus for recording on a recording medium with a recording head, comprising:

a head mounting member for mounting the recording head;

a tray for loading the recording medium recorded by the recording head;

a shaft for rotatably supporting said tray in a rotational motion about a center of rotation between a use position in which the recording medium is loadable thereon and an accommodation position; and a regulation unit abuttable against said tray when in the accommodation position so as to regulate the rotational motion of said tray to thereby maintain said tray in the accommodation position, wherein said tray is released from said regulation unit by application of a rotational force to move the center of rotation of said shaft in a direction transverse to the axis of the center of rotation and slide said tray over said regulation unit.

* * * * *

UNITED STATES PATENT AND TRADEMARK OFFICE

CERTIFICATE OF CORRECTION

PATENT NO. : 6,409,166 B1
DATED : June 25, 2002
INVENTOR(S) : Kashimura

It is certified that error appears in the above-identified patent and that said Letters Patent is hereby corrected as shown below:

Column 1,
Line 4, "Filed" should read -- Field --.
Line 26, "a" should be deleted.
Line 43, "a" should read -- the --.
Line 52, "due" should read -- due to --.
Line 56, "a" should be deleted.
Line 62, "increases" should read -- increase --, and "a" should be deleted.

Column 3,
Line 9, "invention is" should read -- invention. --.
Line 10, "used." should be deleted.
Lines 37 and 42, "a" should be deleted.

Column 4,
Line 44, "to" should read -- at --.
Lines 47 and 50, "to" should read -- on --.

Column 5,
Lines 4 and 15, "to" should read -- in --.
Line 41, "or" (first occurrence) should be deleted.
Line 64, "to" should read -- on --.

Column 6,
Line 14, "to" should read -- on --.
Line 39, "other" should read -- another --.
Line 59, "is" (second occurrence) should read -- are --.

Signed and Sealed this

Ninth Day of September, 2003

JAMES E. ROGAN
*Director of the United States Patent and Trademark Office*